US005983047A

United States Patent [19]

Lee

[11] Patent Number: 5,983,047

[45] Date of Patent: Nov. 9, 1999

[54] DEVELOPER SUPPLY METHOD OF WET ELECTROGRAPHIC PRINTER

[75] Inventor: Hyong-gu Lee, Puchun, Rep. of Korea

[73] Assignee: Samsung Electronics Co., Ltd., Kyungki-do, Rep. of Korea

[21] Appl. No.: 09/124,771

[22] Filed: Jul. 30, 1998

[30] Foreign Application Priority Data

Dec. 12, 1997 [KR] Rep. of Korea ..... 97-68324

[51] Int. Cl.[6] ..... G03G 15/10

[52] U.S. Cl. ..... 399/57; 399/58; 399/238

[58] Field of Search ..... 399/57, 58, 238

[56] References Cited

U.S. PATENT DOCUMENTS

| | | | |
|---|---|---|---|
| 4,281,620 | 8/1981 | McChesney et al. | 118/410 |
| 4,800,839 | 1/1989 | Ariyama et al. | 399/57 |
| 5,724,629 | 3/1998 | Iino et al. | 399/57 |

FOREIGN PATENT DOCUMENTS 8-036280 2/1996 Japan .

*Primary Examiner*—Matthew S. Smith

*Attorney, Agent, or Firm*—Sughrue, Mion, Zinn, Macpeak & Seas, PLLC

[57] ABSTRACT

A developer supply method of a wet electrographic printer is disclosed. The method having a reservoir for supplying a developer obtained by mixing a liquid carrier with an ink to a developing unit, a carrier cartridge for supplying the liquid carrier to the reservoir, an ink cartridge for supplying the ink to the reservoir, and a process tank for receiving the developer from the reservoir, includes the steps of supplying the liquid carrier and the ink to the reservoir to have an optimum concentration and a maximum level, determining whether the concentration of the developer in the reservoir is less than a minimum concentration, or the level of the developer is less than a minimum level, draining all of the developer in the reservoir to the process tank such that the level of the developer is the minimum level, if the concentration of the developer was less than the minimum concentration or the level was less than the minimum level in the determining step, supplying a predetermined amount of the developer in the process tank to the reservoir in order to measure the concentration of the developer in the process tank using a concentration sensor installed in the reservoir, and supplying the liquid carrier or the ink or the developer in the process tank to the reservoir such that the developer in the reservoir has the optimum concentration and the maximum level.

3 Claims, 4 Drawing Sheets

DEVELOPER SUPPLY METHOD OF WET ELECTROGRAPHIC PRINTER

BACKGROUND OF THE INVENTION

1. Field of the Invention

The present invention relates to a wet electrographic printer, and more particularly, to a developer supply method of a wet electrographic printer, capable of controlling the concentration and level of the developer.

2. Description of the Related Art

In general, a wet electrographic printer is an apparatus for developing an electrostatic latent image, formed on a photosensitive medium such as a photosensitive belt, with a developer of a predetermined color and transferring the developed image to print a desired image. The wet electrographic printer includes a developing unit for developing an image by supplying the developer to the photosensitive medium, and a developer supply apparatus for constantly supplying the developer of a predetermined concentration to the developing unit. The developer is a mixture of a condensed ink, containing a powdery toner, with a liquid carrier, in which the toner is diluted to a concentration of approximately 2~4 wt %. Hereinafter, the concentration of the developer is defined by the wt % of the toner.

Meanwhile, the developer supply apparatus includes an ink cartridge for storing the condensed ink, a carrier cartridge for storing the liquid carrier, and a reservoir for storing the developer obtained by mixing the condensed ink with the liquid carrier at a predetermined ratio. Also, agitators for preventing the toner from settling out of the solution may be installed in the ink cartridge and the reservoir.

In the above developer supply apparatus, the amount of developer stored in the reservoir is reduced by the amount used to develop the electrostatic latent image of the photosensitive medium, so that more condensed ink and liquid carrier must be supplied to the reservoir to maintain the developer at a constant concentration. Also, the level of developer stored in the developer reservoir must be maintained at a constant level.

The consumption of the toner and the liquid carrier may be different according to a printed image. That is, more liquid carrier than toner is required to print a simple image or a small image, and more toner than liquid carrier is required to print a complicated image. Thus, in order to maintain the concentration of the developer at a predetermined concentration, it is necessary to appropriately supply the toner and the developer to the reservoir in accordance with the respective consumption of the toner and the liquid carrier.

The developer supply method cannot control both the concentration of the developer stored in the reservoir and the level thereof. That is, if a lot of the liquid carrier is supplied to maintain the predetermined concentration of the developer in the reservoir, the level of the developer is changed and thus undesired operating conditions may develop. On the other hand, if the level of the developer is controlled, the concentration of the developer may not be maintained at the constant level.

SUMMARY OF THE INVENTION

To solve the above problems, it is an objective of the present invention to provide a developer supply method of a wet electrographic printer, capable of appropriately controlling the concentration and level of the developer.

Accordingly, to achieve the above objective, a developer supply method of a wet electrographic printer including a reservoir for supplying a developer obtained by mixing a liquid carrier with an ink to a developing unit, a carrier cartridge for supplying the liquid carrier to the reservoir, an ink cartridge for supplying the ink to the reservoir, and a process tank for receiving the developer from the reservoir, includes the steps of: supplying the liquid carrier and the ink to the reservoir to have an optimum concentration and a maximum level; determining whether the concentration of the developer in the reservoir is less than a minimum concentration, or the level of the developer is less than a minimum level; draining all of the developer in the reservoir to the process tank such that the level of the developer is the minimum level, if the concentration of the developer was less than the minimum concentration or the level was less than the minimum level in the determining step; supplying a predetermined amount of the developer in the process tank to the reservoir in order to measure the concentration of the developer in the process tank using a concentration sensor installed in the reservoir; and supplying the liquid carrier or the ink or the developer in the process tank to the reservoir such that the developer in the reservoir has the optimum concentration and the maximum level.

Also, the method further includes the steps of determining whether the ink cartridge is used up, and draining the developer in the reservoir and/or the process tank to the ink cartridge, if the ink cartridge was used up.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
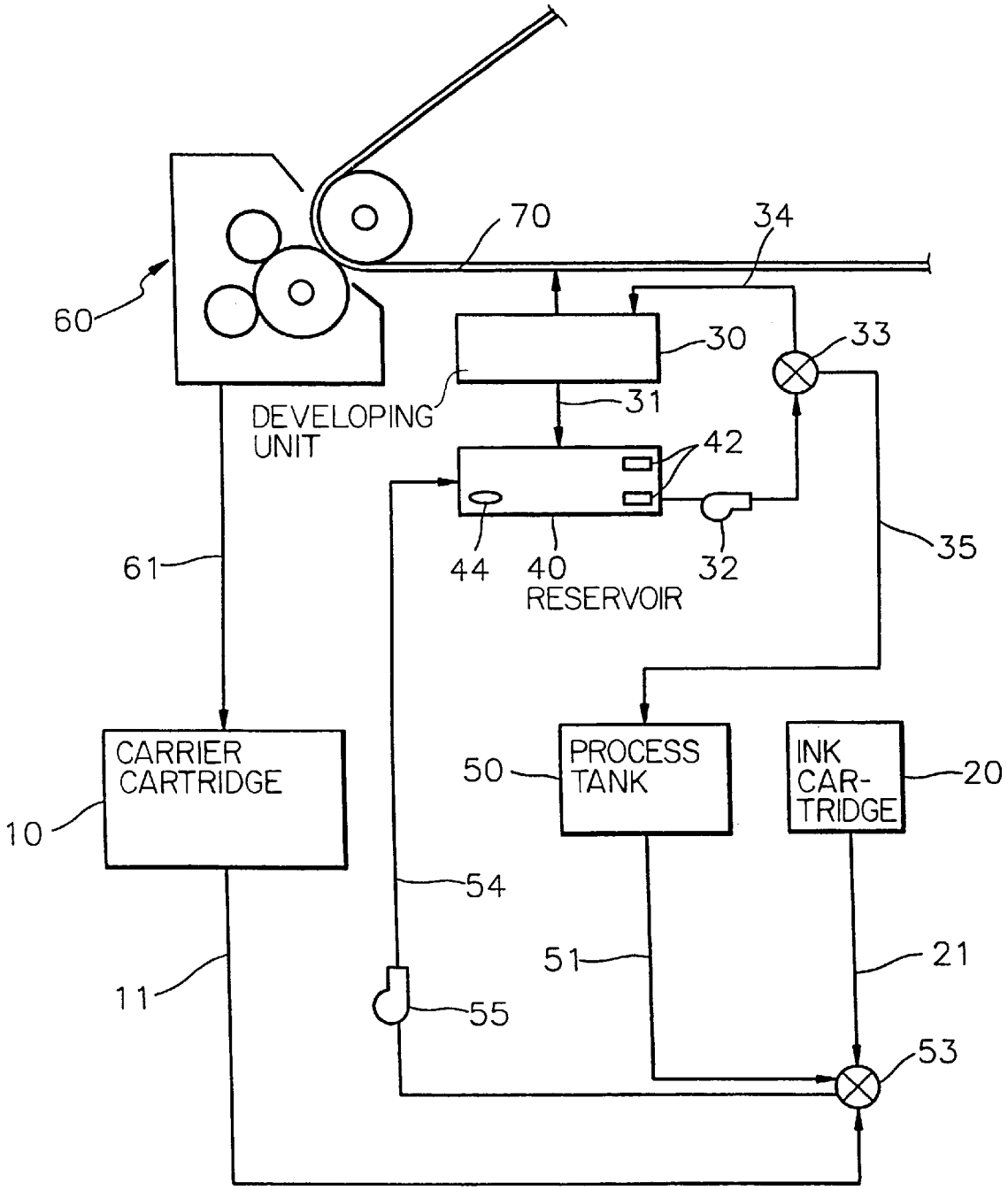
FIG. 1 is a schematic diagram of a developer supply apparatus of a wet electrographic printer employing a developer supply method according to an embodiment of the present invention.

Referring to FIG. 1 showing the structure of a developer supply apparatus of a wet electrographic printer employing a developer supply method according to an embodiment of the present invention, a liquid carrier is stored in a carrier cartridge 10, and condensed ink is stored in an ink cartridge 20. The carrier cartridge 10 and the ink cartridge 20 are replaceable.

The carrier cartridge 10, the ink cartridge 20 and a process tank 50 are connected to a first valve 53 such as a solenoid three-way valve through a carrier supply path 11, an ink supply path 21 and a recycle path 51, respectively. The first valve 53 selectively opens and closes the carrier supply, path 11, the ink supplying path 21 and the recycle path 51, so that ink, a liquid carrier or developer in the process tank 50 are supplied to a reservoir 40 through an ink/carrier supply path 54 by the driving force of a first pump 55.

A level sensor 42 for sensing the level of the developer in the reservoir 40 and a concentration sensor 44 for sensing the concentration thereof are installed in the reservoir 40. Also, the reservoir 40 supplies the developer obtained by mixing the ink with the liquid carrier to a developing unit 30 through a developer supply path 34 by the driving force of a second pump 32. The developing unit 30 develops an electrostatic latent image formed on a photosensitive belt 70 using the developer supplied from the reservoir 40.

A second valve 33 such as a solenoid two-way valve is installed in the developer supply path 34, and the second valve 33 selectively blocks the developer supply path 34 and a developer drain path 35 to direct the developer to the developer unit 30 or the process tank 50, through the developer supply path 34 or the developer drain path 35, respectively.

Reference numeral 60 denotes a drying unit for recovering liquid carrier adhering to the electrostatic latent image of the photosensitive belt 70, where the collected liquid carrier returns to the carrier cartridge 10 along a collection pipe 61.

Figure 2:
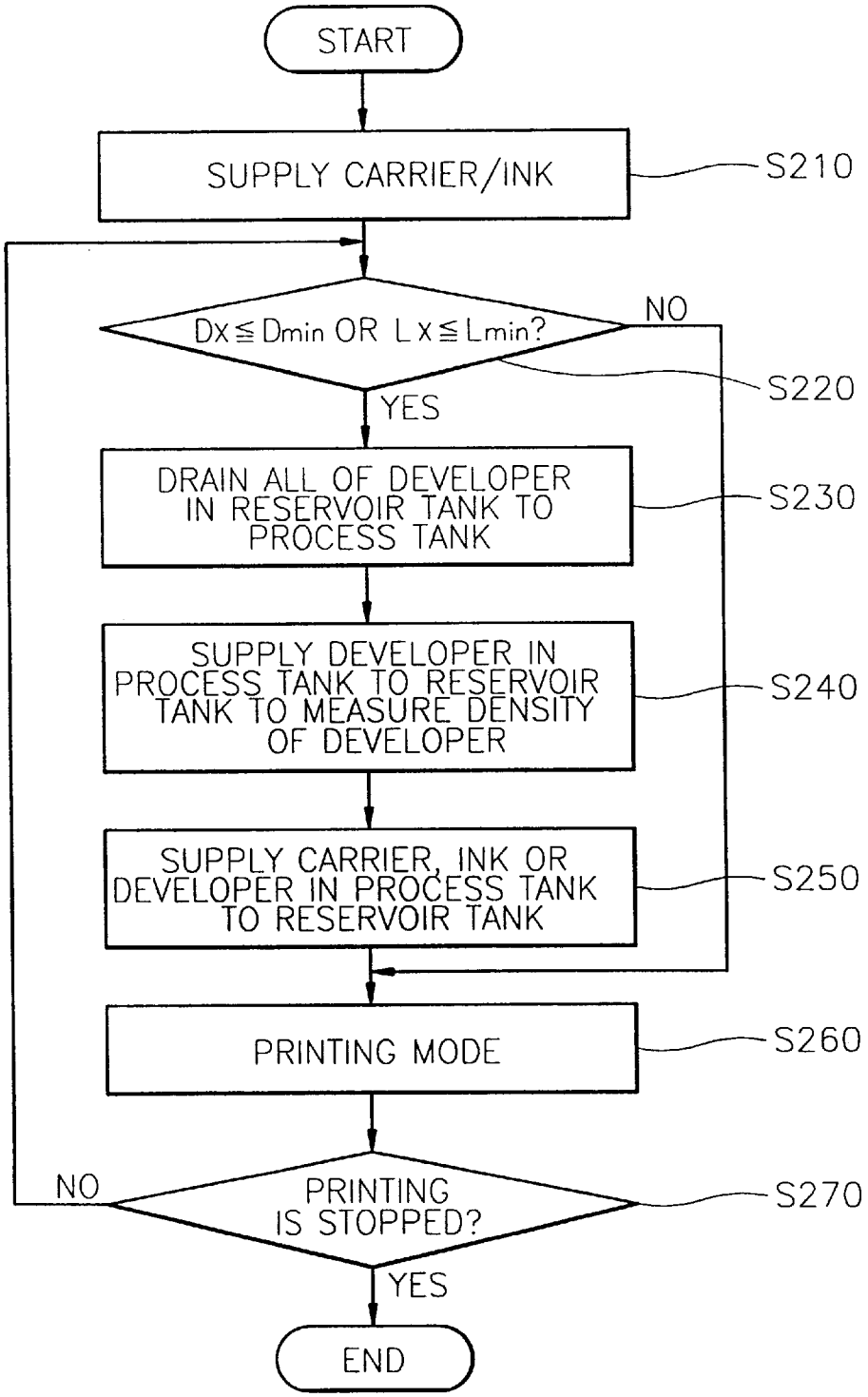
FIG. 2 is a flowchart of a developer supply method according to an embodiment of the present invention.

The developer supply method used in an apparatus having the above structure will be described with reference to FIGS. 1 and 2.

When the power of a printer is turned on, the liquid carrier and ink are supplied to the reservoir 40 (step 210). That is, the first valve 53 closes the recycle path 51 and selectively opens the ink supply path 21 and the carrier supply path 11 to supply the ink and the liquid carrier from the ink cartridge 20 and the carrier cartridge 10 to the reservoir 40 through the ink/carrier supply path 54. The supplied ink and liquid carrier are mixed to give a developer appropriate for printing, having a concentration $D_x$ an optimum concentration $D_{opt}$ between a minimum concentration $D_{min}$ and the maximum concentration $D_{max}$, and the level $L_x$ of the developer equal to a maximum level $L_{max}$. The concentration and level of the developer are controlled appropriately according to printing conditions.

The developer in the reservoir 40 is supplied to the developer unit 30 along the developer supply path 34 by the driving force of the second pump 32. At this time, the developer drain path 35 is closed. Thus, the electrostatic latent image formed on the photosensitive belt 70 is developed using the supplied developer. At this time, excess developer supplied to the photosensitive belt 70 is eliminated by collection means such as a squeegee roller (not shown), to collect in the reservoir 40 through the path 31.

Subsequently, it is determined by the level sensor 42 and the concentration sensor 44 whether the concentration $D_x$ of the developer in the reservoir 40 is less than the minimum concentration $D_{min}$, and the level $L_x$ thereof is less than a minimum level $L_{min}$ (step 220). If the concentration Dx and the level $L_x$ are above the minimum levels, the sequence proceeds to step 260. Here, the minimum concentration $D_{min}$ is determined by the criterion that print quality starts to deteriorate unacceptably. When the amount of consumed ink is different from that of the carrier in the above-described printing conditions during printing, the concentration of the developer collected through the path 31 may be different from that of the developer supplied through the developer supply path 34, causing the concentration of the developer stored in the reservoir 40 to change. Thus, the concentration sensor 44 senses and measures abnormal concentration of the developer to transmit the measurement to a controller (not shown).

If the concentration $D_x$ of the developer is less than the minimum concentration $D_{min}$ or the level $L_x$ thereof is less than the minimum level $L_{min}$, all of the developer in the reservoir 40 is drained to the process tank 50 (step 230). That is, the controller stops the printing according to the signals, and operates the second valve 33 to block the developer supply path 34 and opens the developer drain path 35. Thus, all of the developer in the reservoir is drained to the process tank 50 by the second pump 32.

Subsequently, a predetermined amount, i.e., a test level $L_{tst}$ of developer in the process tank 50, is supplied to the reservoir 40 (step 240). This is for measuring the concentration of the developer in the process tank 50 using the concentration sensor 44 installed in the reservoir 40. That is, the concentration of the developer in the process tank 50 is measured even though no additional concentration sensor is installed in the process tank 50. Here, the test level $L_{tst}$ can be properly controlled according to printing conditions.

The developer of the process tank 50 is supplied together with the liquid carrier and/or ink to the reservoir 40 until the level and concentration of the final developer in the reservoir 40 become a maximum level $L_{max}$ and an optimum concentration $D_{opt}$ (step 250). At this time, the supply ratio of the liquid carrier and ink are properly controlled depending on the concentration of the developer in the process tank.

Subsequently, the above-described printing is performed (step 260).

It is determined whether the printing is completed (step 270). If the printing is not completed, the sequence returns to step 220.

According to the present invention, all of the developer in the reservoir 40 is drained to the process tank 50, and the drained developer is partially supplied to the reservoir 40, to thereby check the concentration of the developer in the process tank 50. Thus, the concentration and level of the developer in the reservoir 40 can be easily controlled.

Figure 3:
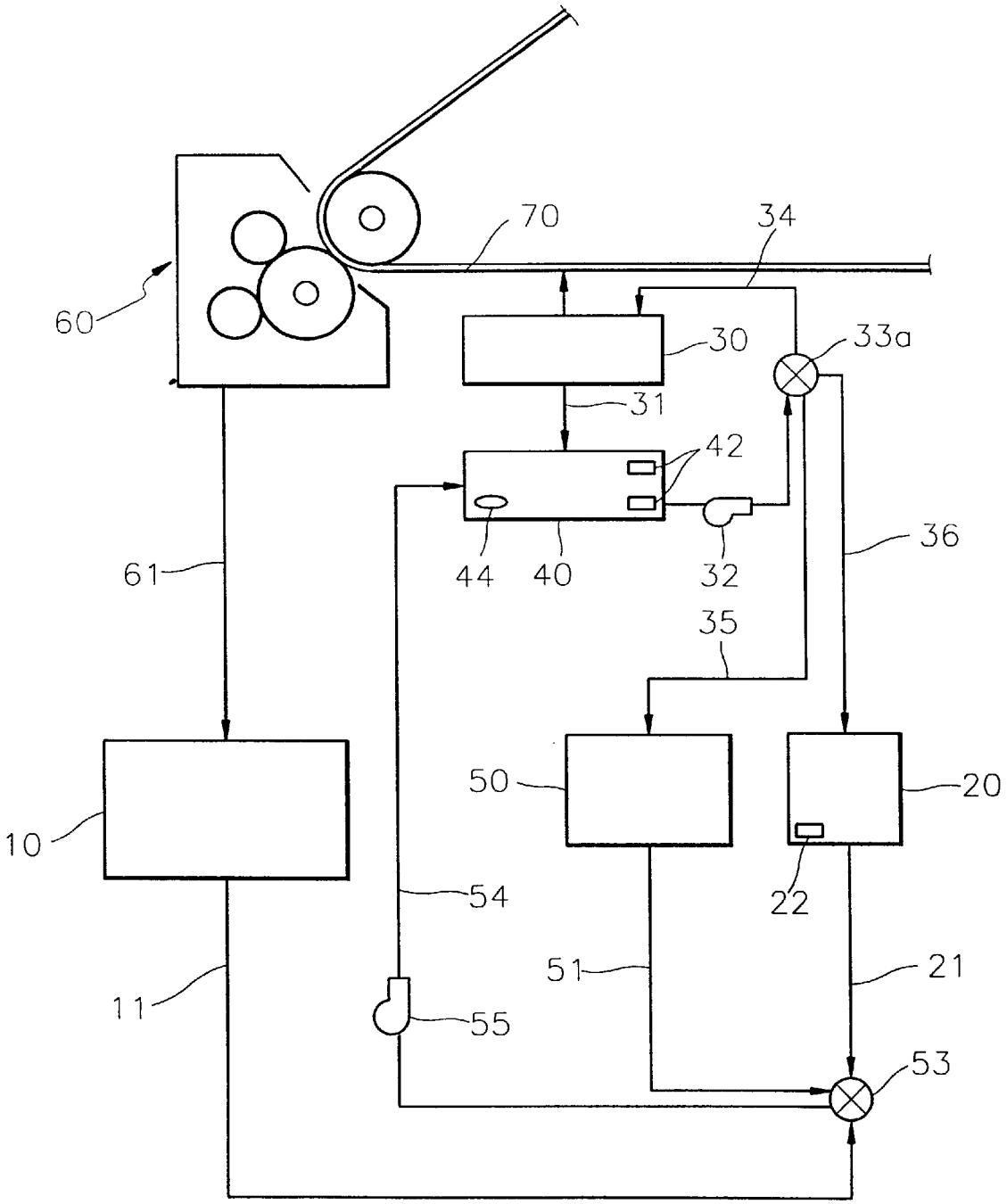
FIG. 3 is a schematic diagram of a developer supply apparatus of a wet electrographic printer employing a developer supply method according to another embodiment of the present invention.

The structure of the developer supply apparatus employing the developer supply method according to another embodiment of the present invention is shown in FIG. 3. The same reference numerals represent the same elements having the same functions as those shown in FIG. 1.

Here, when the used-up ink cartridge 20 is replaced with a new one, the developer in the reservoir 40 and/or the process tank 50, which may include impurities, is drained to the used-up ink cartridge 20 to remove the ink together with the used-up ink cartridge 20. That is, the ink cartridge 20 is connected to a third valve 33*a* such as a solenoid three-way valve via a developer removal path 36. The third valve 33*a* selectively opens and closes a developer supply path 34, a developer drain path 35 and a developer removal path 36. A level sensor 22 is installed in the ink cartridge 20, to sense whether the ink in the ink cartridge 20 is used up.

Figure 4:
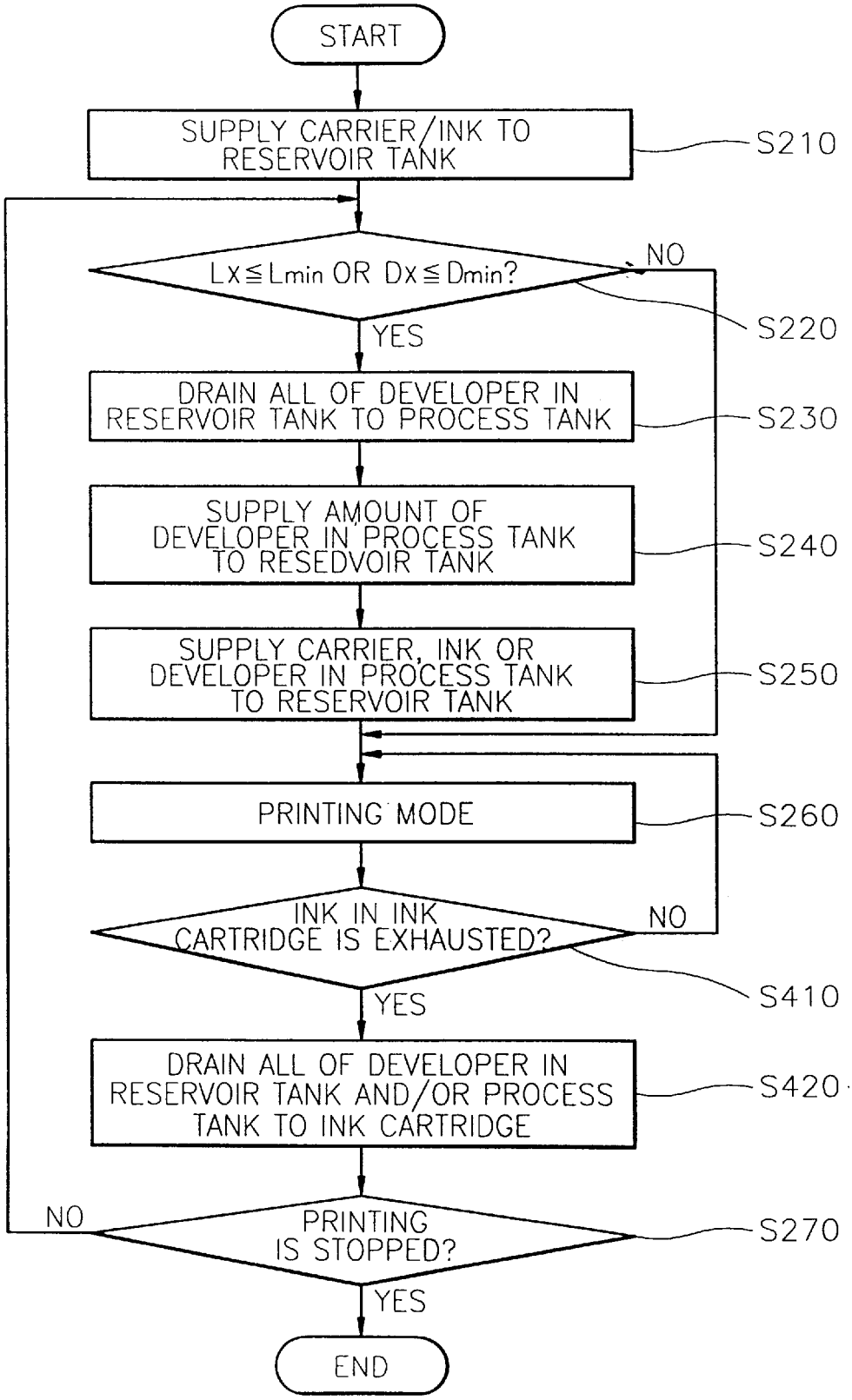
FIG. 4 is a flowchart of a developer supply method according to another embodiment of the present invention.

The developer supply method according to the present invention will be described with reference to FIGS. 3 and 4. Steps 210 through 270 are the same as those of the above-described embodiment.

It is determined whether the ink cartridge 20 is used up (step 410). That is, if the ink level $L_{i,x}$ of the ink cartridge 20 drops to a predetermined minimum level $L_{i,\,min}$, the level sensor 22 senses the information and transmits the information to a controller.

Subsequently, the developer in the reservoir 40 and/or the process tank 50 are drained to the ink cartridge 20 (step 420).

Finally, if the ink in the ink cartridge 20 is used up during printing, the controller temporarily stops the printing and operates the third valve 33*a*, to block the developer supply path 34 and the developer drain path 35 and open the developer removal path 36. Thus, the developer in the reservoir 40 is drained to the ink cartridge 20 through the developer removal path 36.

In order to remove the developer from the process tank 50, the controller drives the first valve 53 to supply the developer in the process tank 50 to the reservoir 40 through a recycle path 51 and the ink/carrier supply path 54, and then drives the third valve 33*a* to finally drain the developer to the ink cartridge 20 through the developer removing path 36.

The methods of the present invention will be more apparent through example embodiments as follows. The developer used in the example embodiments is a solution obtained by mixing approximately 133 ml of ink with approximately 267 ml of liquid carrier, and the maximum level $L_{max}$ is approximately 400 ml and the minimum level $L_{min}$ is 340 ml. The "coverage" used in the example embodiment is defined as the ratio of the area of a printed image to that of a sheet of A4 paper.

EXAMPLE EMBODIMENT 1

If the coverage is 5% and 670 sheets of paper are printed, the concentration and level of the developer in the reservoir 40 become 2 wt % and 345 ml, respectively. Thus, the controller temporarily stops the printing upon receiving a signal transmitted from the concentration sensor 44 (step 220 of FIG. 2).

Here, all 345 ml of the developer is drained to the process tank 50 (step 230). Then, 200 ml of the developer in the process tank 50 is supplied to the reservoir 40 (step 240), and the concentration of the developer in the process tank 50 is measured using the concentration sensor 44. Subsequently, 57.1 ml of ink together with 142.9 ml of the developer in the process tank 50 is additionally supplied (step 250). Thus, the reservoir 40 contains the developer having the maximum level and the optimum concentration.

EXAMPLE EMBODIMENT 2

If the coverage is 100% and 27 sheets of paper are printed, the concentration and level of the developer become 2 wt % and 390 ml, respectively. As described above, the printing is stopped (step 220 of FIG. 2), and then all 390 ml of the developer in the reservoir 40 is drained to the process tank 50 (step 230).

Subsequently, if 200 ml of the developer in the process tank 50 is supplied to the reservoir 40 (step 240), the concentration is 1.89 wt %. Thus, if 66.7 ml of ink together with 133.3 ml of the developer in the process tank 50 are additionally supplied (step 250), the developer in the reservoir 40 has the optimum concentration and the maximum level, respectively.

According to the above-described present invention, an additional process tank is provided so that all of the developer in the reservoir is drained to easily control the concentration and level of the developer in the reservoir. Also, no concentration sensor is required for the process tank, to thereby save costs. The developer in the process tank can be reused while maintaining the correct concentration of the developer.

In the specification, the developer supply method for one developing unit is disclosed. However, the above developer supply method may also be employed in an electrographic color printer having a plurality of developing units, corresponding to colors of e.g. yellow, magenta, cyan and black.

What is claimed is:

1. A developer supply method of a wet electrographic printer including a reservoir for supplying a developer obtained by mixing a liquid carrier with an ink to a developing unit, a carrier cartridge for supplying the liquid carrier to the reservoir, an ink cartridge for supplying the ink to the reservoir, and a process tank for receiving the developer from the reservoir, comprising the steps of:

(a) supplying the liquid carrier and the ink to the reservoir to have an optimum concentration and a maximum level;

(b) determining whether the concentration of the developer in the reservoir is less than a minimum concentration, and determining whether the level of the developer is less than a minimum level;

(c) draining all of the developer in the reservoir to the process tank when at least one of the concentration of the developer is less than the minimum concentration and the level of the developer is less than the minimum level as determined in step (b);

(d) supplying a predetermined amount of the developer in the process tank to the reservoir in order to measure the concentration of the predetermined amount of the developer in the process tank using a concentration sensor installed in the reservoir; and (e) supplying at least one of the liquid carrier, the ink, and the developer in the process tank to the reservoir such that the developer in the reservoir has the optimum concentration and the maximum level.

2. The method of claim 1, further comprising the step of:

(f) determining whether the ink cartridge is used up.

3. The method of claim 2, further comprising the step of:

(g) draining at least one of the developer in the reservoir and the developer in the process tank to the ink cartridge, when the ink cartridge is determined to be used up in step (f).

* * * * *